US006292774B1

(12) United States Patent
Taori et al.

(10) Patent No.: US 6,292,774 B1
(45) **Date of Patent: *Sep. 18, 2001**

(54) INTRODUCTION INTO INCOMPLETE DATA FRAMES OF ADDITIONAL COEFFICIENTS REPRESENTING LATER IN TIME FRAMES OF SPEECH SIGNAL SAMPLES

(75) Inventors: Rakesh Taori; Andreas J. Gerrits, both of Eindoven (NL)

(73) Assignee: U.S. Philips Corporation, New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/052,292

(22) Filed: Mar. 31, 1998

(30) Foreign Application Priority Data

Apr. 7, 1997 (EP) ..... 97200999

(51) Int. Cl.[7] ..... G10L 9/00
(52) U.S. Cl. ..... 704/201
(58) Field of Search ..... 704/201, 220, 704/219, 223, 216, 221

(56) References Cited

U.S. PATENT DOCUMENTS

| | | | | |
|---|---|---|---|---|
| 4,379,949 | | 4/1983 | Chen et al. | 179/15.55 R |
| 5,012,518 | * | 4/1991 | Liu et al. | 704/221 |
| 5,479,559 | * | 12/1995 | Fette et al. | 704/208 |
| 5,504,834 | * | 4/1996 | Fette et al. | 704/219 |
| 5,623,575 | * | 4/1997 | Fette et al. | 704/265 |

* cited by examiner

*Primary Examiner*—William Korzuch
*Assistant Examiner*—Donald L. Storm

(57) ABSTRACT

A transmission system has a speech encoder and a speech decoder. From frames of speech signal samples, the speech encoder derives data frames with coefficients representing the frames of speech signal samples. The data frames, that include complete and incomplete data frames, are transmitted to a speech decoder. As compared to a complete data frame, an incomplete data frame carries an incomplete set of coefficients. The speech decoder introduces additional coefficients into incomplete data frames. The additional coefficients represent frames of speech signal samples that are later in time than the frames of speech signal samples corresponding to the incomplete data frames. The speech decoder uses the additional coefficients to complete incomplete sets of coefficients.

9 Claims, 7 Drawing Sheets

INTRODUCTION INTO INCOMPLETE DATA FRAMES OF ADDITIONAL COEFFICIENTS REPRESENTING LATER IN TIME FRAMES OF SPEECH SIGNAL SAMPLES

BACKGROUND OF THE INVENTION

1. Field of the Invention

The present invention is related to a transmission system comprising a transmitter with a speech encoder for deriving from frames of speech signal samples, data frames with coefficients representing said frames of speech signal samples, the speech encoder comprising frame assembling means for assembling complete data frames and incomplete data frames, said incomplete data frames comprising an incomplete set of coefficients representing their frame of speech signal samples, the transmitter further comprises transmit means to transmit said data frames via a transmission medium to a receiver, the receiver comprises a speech decoder, said speech decoder comprising completion means for completing the incomplete sets of coefficients with interpolated coefficients obtained from coefficients corresponding to frames of speech signal samples surrounding the frames of speech signal samples corresponding to said incomplete data frame The present invention is also related to a transmitter, a receiver, an encoder, a decoder, a speech coding method and a coded speech signal.

2. Description of the Related Art

A transmission system according to the preamble is known from U.S. Pat. No. 4,379,949.

Such transmission systems are used in applications in which speech signals have to be transmitted over a transmission medium with a limited transmission capacity or have to be stored on storage media with a limited storage capacity. Examples of such applications are the transmission of speech signals over the Internet, the transmission of speech signals from a mobile phone to a base station and vice versa and storage of speech signals on a CD-ROM, in a solid state memory or on a hard disk drive.

A speech encoder derives from a frame of speech samples data frames comprising coefficients representing said frames of speech signal samples. These coefficients comprise analysis coefficients and excitation coefficients. A group of these analysis coefficients describe the short time spectrum of the speech signal. An other example of an analysis coefficient is a coefficient representing the pitch of a speech signal. The analysis coefficients are transmitted via the transmission medium to the receiver where these analysis coefficients are used as coefficients for a synthesis filter.

Besides the analysis parameters, the speech encoder also determines a number of excitation sequences (e.g. 4) per frame of speech samples. The interval of time covered by such excitation sequence is called a sub-frame. The speech encoder is arranged for finding the excitation signal resulting in the best speech quality when the synthesis filter, using the above mentioned analysis coefficients, is excited with said excitation sequences. A representation of said excitation sequences is transmitted as coefficients in the data frames via the transmission channel to the receiver. In the receiver, the excitation sequences are recovered from the received signal and applied to an input of the synthesis filter. At the output of the synthesis filter a synthetic speech signal is available.

The bitrate required to describe a speech signal with a certain quality depends on the speech content. It is possible that some of the coefficients carried by the data frames are substantially constant over a prolonged period of time, e.g. in sustained vowels. This property can be exploited by transmitting in such cases incomplete data frames comprising an incomplete set of coefficients.

This possibility is used in the transmission system according to the above mentioned U.S. patent. This patent describes a transmission system with a speech encoder in which the analysis coefficients are not transmitted every frame. These analysis coefficients are only transmitted if the difference between at least one of the actual analysis coefficients in a data frame and a corresponding analysis coefficient obtained by interpolation of the analysis coefficients from neighboring data frames exceeds a predetermined threshold value. This results in a reduction of the bitrate required for transmitting the speech signal.

A disadvantage of the transmission system according to the above mentioned U.S. patent is that the speech signal is always delayed over several frames due to the interpolation to be performed.

SUMMARY OF THE INVENTION

The object of the present invention is to provide a transmission system in which the delay of the speech signal has been reduced.

Therefor the transmission system according to the invention is characterized in that said assembling means being arranged for introducing into at least one of said incomplete data frames, additional coefficients representing frames of speech signal samples being later in time than the frames of speech signal samples corresponding to said incomplete data frames, and in that the completion means are arranged for completing the incomplete sets of coefficients using said additional coefficients.

By transmitting the additional coefficients representing later frames of speech signal samples in the incomplete data frames, these additional coefficients are available at least one frame interval earlier in the decoder. Because these additional coefficients are used for completing the incomplete set of coefficients by interpolation, this interpolation can also be performed at least one frame interval earlier. Consequently the synthesis of the reconstructed speech signal can take place earlier and the signal delay is reduced with at least one frame interval.

An embodiment of the invention is characterized in that the frame assembling means are arranged for introducing into the data frames indicators for indicating whether or not the frame is an incomplete data frame, and whether or not the data frames carry coefficients representing frames of speech samples different from its corresponding frames of speech samples.

The introduction of the first and second indicator, enable a very easy decoding in the receiver. The completion means in the receiver can easily extract the incomplete frames from the input signal, and start with completion (by interpolation) as soon an incomplete frame carrying additional coefficients is available. If only one indicator is present, the speech decoder needs the indicators corresponding to previous data frame to be able to decode the signal. This requires a very reliable communication to prevent errors in or loss of data frames.

BRIEF DESCRIPTION OF THE DRAWINGS

The present invention will now be explained with reference to the drawings. Herein shows.

DESCRIPTION OF THE PREFERRED EMBODIMENTS

Figure 1:
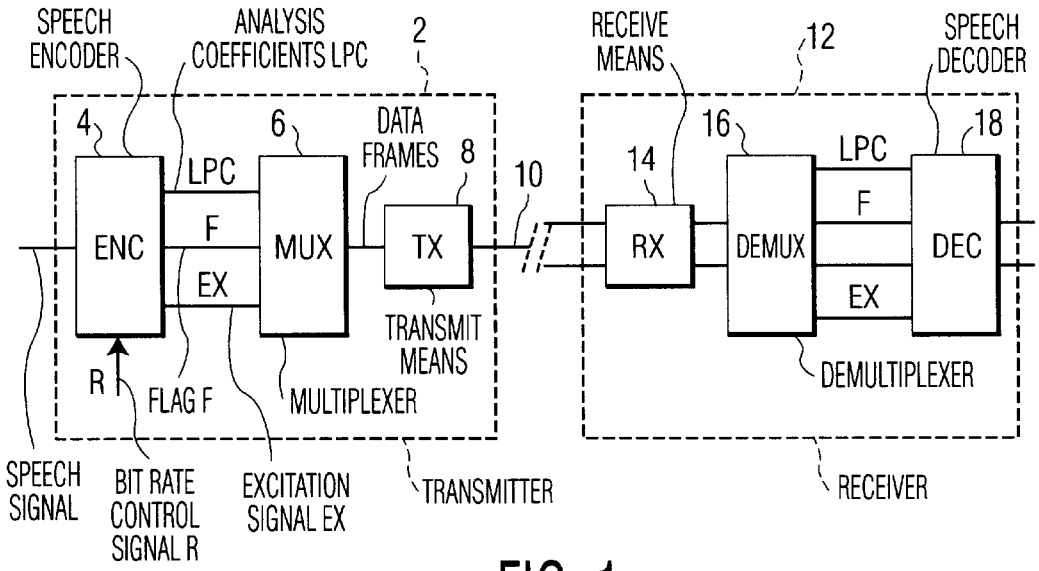
FIG. 1, a transmission system in which the invention can be applied.

In the transmission system according to FIG. 1, the speech signal to be encoded is applied to an input of an speech encoder 4 in a transmitter 2. A first output of the speech encoder 4, carrying an output signal LPC representing the analysis coefficients, is connected to a first input of a multiplexer 6. A second output of the speech encoder 4, carrying an output signal F, is connected to a second input of a multiplexer 6. The signal F represents a flag indicating whether the signal LPC has to be transmitted or not. A third output of the speech encoder 4, carrying a signal EX, is connected to a third input of the multiplexer 6. The signal EX represents an excitation signal for the synthesis filter in a speech decoder. A bitrate control signal R is applied to a second input of the speech encoder 4.

An output of the multiplexer 6 is connected to an input of transmit means 8. An output of the transmit means 8 is connected to a receiver 12 via a transmission medium 10.

In the receiver 12, the output of the transmission medium 10 is connected to an input of receive means 14. An output of the receive means 14 is connected to an input of a demultiplexer 16. A first output of the demultiplexer 16, carrying the signal LPC, is connected to a first input of speech decoding means 18 and a second output of the demultiplexer 16, carrying the signal EX is connected to a second input of the speech decoding means 18. At the output of the speech decoding means 18 the reconstructed speech signal is available. The combination of the demultiplexer 16 and the speech decoding means 18 constitute the speech decoder according to the present inventive concept.

The operation of the transmission system according to the invention is explained under the assumption that a speech encoder of the CELP type is used, but it is observed that the scope of the present invention is not limited thereto.

The speech encoder 4 is arranged to derive an encoded speech signal from frames of samples of a speech signal. The speech encoder derives analysis coefficients representing e.g. the short term spectrum of the speech signal. In general LPC coefficients, or a transformed representation thereof, are used. Useful representations are Log Area Ratios (LARs). arcsines of reflection coefficients or Line Spectral Frequencies (LSFs) also called Line Spectral Pairs (LSPs). The representation of the analysis coefficients is available as the signal LPC at the first output of the speech encoder 4.

In the speech encoder 4 the excitation signal is equal to a sum of weighted output signals of one or more fixed codebooks and an adaptive codebook. The output signals of the fixed codebook is indicated by a fixed codebook index, and the weighting factor for the fixed codebook is indicated by a fixed codebook gain. The output signals of the adaptive codebook is indicated by an adaptive codebook index, and the weighting factor for the adaptive codebook is indicated by an adaptive codebook gain.

The codebook indices and gains are determined by an analysis by synthesis method, i.e. the codebook indices and gains are determined such that a difference measure between the original speech signal and a speech signal synthesized on basis of the excitation coefficients and the analysis coefficients, has a minimum value. The signal F indicates whether the analysis parameters corresponding to the current frame of speech signal samples are transmitted or not. These coefficients can be transmitted in the current data frame or in an earlier data frame.

The multiplexer 6 assembles data frames with a header and the data representing the speech signal. The header comprises a first indicator (the flag F) indicating whether the current data frame is an incomplete data frame or not. The header optionally comprises a second indicator (a flag L) which indicates whether the current data frame carries analysis parameters or not. The frame further comprises the excitation parameters for a plurality of sub-frames. The number of sub-frames is dependent on the bitrate chosen by the signal R at the control input of the speech encoder 4. The number of sub-frames per frame and the frame length can also be encoded in the header of the frame, but it is also possible that the number of sub-frames per frame and the frame length are agreed upon during connection setup. At the output of the multiplexer 6, the completed frames representing the speech signal are available.

In the transmit means 8, the frames at the output of the multiplexer 6 are transformed into a signal that can be transmitted via the transmission medium 10. The operations performed in the transmit means involve error correction coding, interleaving and modulation.

The receiver 12 is arranged to receive the signal transmitted by the transmitter 2 from the transmission medium 10. The receive means 14 are arranged for demodulation, de-interleaving and error correcting decoding. The demultiplexer extracts the signals LPC, F and EX from the output signal of the receive means 14. If necessary the demultiplexer 16 performs an interpolation between two sets of subsequently received sets of coefficients. The completed sets of coefficients LPC and EX are provided to the speech decoding means 18. At the output of the speech decoding means 18, the reconstructed speech signal is available.

Figure 2:
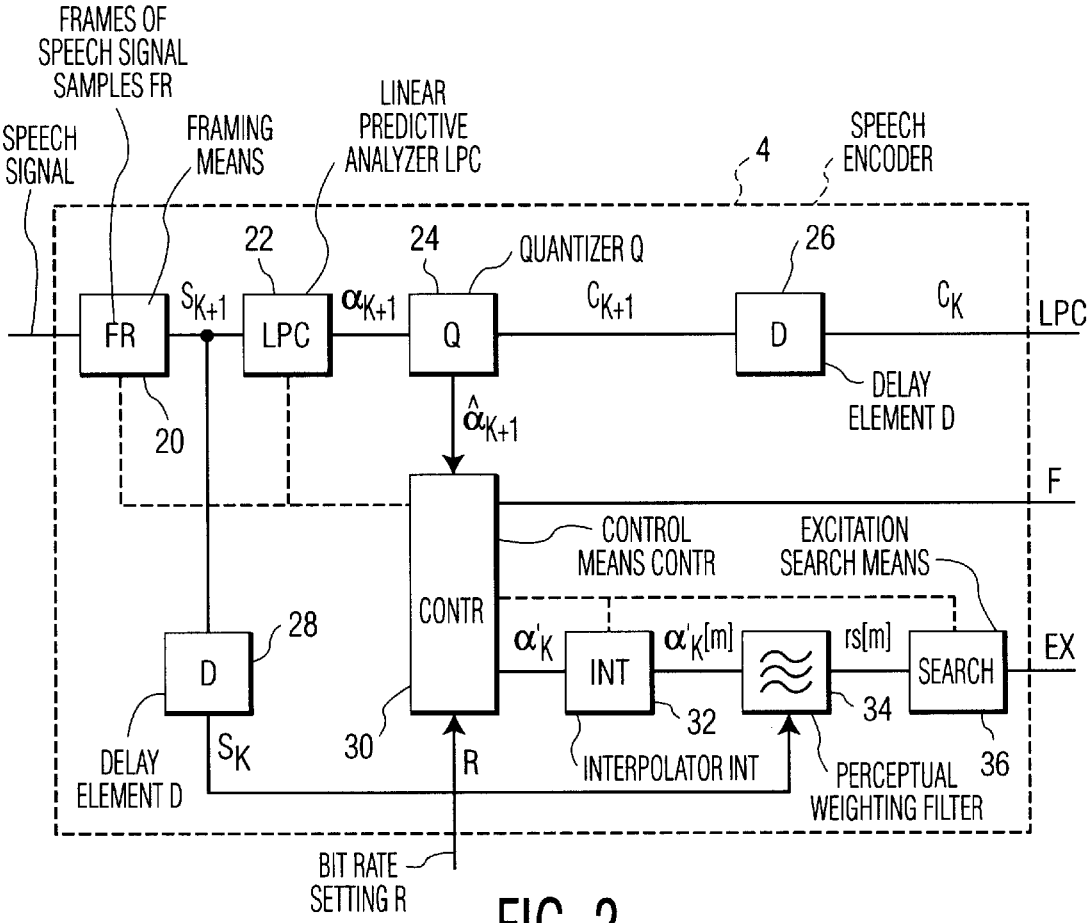
FIG. 2, an embodiment of coding means delivering frames of coded speech signals which can be used in the present invention.

In the speech encoder according to FIG. 2, the input signal is applied to an input of framing means 20. An output of the framing means 20, carrying an output signal $S_{k+1}$, is connected to an input of the analysis means, being here a linear predictive analyzer 22, and to an input of a delay element 28. The output of the linear predictive analyzer 22, carrying a signal $\alpha_{k+1}$, is connected to an input of a quantizer 24. A first output of the quantizer 24, carrying an output signal $C_{k-1}$, is connected to an input of a delay element 26, and to a first output of the speech encoder 6. An output of the delay element 26, carrying an output signal $C_k$, is connected to a second output of the speech encoder.

A second output of the quantizer 24 carrying a signal $\hat{\alpha}_{k+1}$, is connected to an input of the control means 30. An input signal R, representing a bitrate setting, is applied to a second input of the control means 30. A first output of the control means 30, carrying an output signal F, is connected to an output of the speech encoder 4.

A third output of the control means 30, carrying an output signal $\alpha'_k$ is connected to an interpolator 32. An output of the interpolator 32, carrying an output signal $\alpha'_k[m]$, is connected to a control input of a perceptual weighting filter 32.

The output of the framing means 20 is also connected to an input of a delay element 28. An output of the delay element 28, carrying a signal $S_k$, is connected to a second input of the perceptual weighting filter 34. The output of the perceptual weighting filter 34, carrying a signal rs[m], is connected to an input of excitation search means 36. At the output of the excitation search means 36 a representation of the excitation signal EX comprising the fixed codebook index, the fixed codebook gain, the adaptive codebook index and the adaptive codebook gain are available at the output of the excitation search means 36.

The framing means derives from the input signal of the speech encoder 4, frames FR comprising a plurality of input samples. The number of samples within a frame can be changed according to the bitrate setting R. The linear predictive analyzer 22 derives a plurality of analysis coefficients comprising prediction coefficients $\alpha_{k+1}[p]$, from the frames of input samples. These prediction coefficients can be found by the well known Levinson-Durbin algorithm. The quantizer 24 transforms the coefficients $\alpha_{k+1}[p]$ into another representation, and quantizes the transformed prediction coefficients into quantized coefficients $C_{k+1}[p]$, which are passed to the output via the delay element 26 as coefficients $C_{k+1}[p]$. The purpose of the delay element is to ensure that the coefficients $C_k[p]$ and the excitation signal EX corresponding to the same frame of speech input samples are presented simultaneously to the multiplexer 6. The quantizer 24 provides a signal $\hat{\alpha}_{k+1}$ to the control means 30. The signal $\hat{\alpha}_{k+1}$ is obtained by a inverse transform of the quantized coefficients $C_{k+1}$. This inverse transform is the same as is performed in the speech decoder in the receiver. The inverse transform of the quantized coefficients is performed in the speech encoder, in order to provide the speech encoder for the local synthesis with exactly the same coefficients as are available to a decoder in the receiver.

The control means 30 are arranged to derive the fraction of the frames in which more information about the analysis coefficients is transmitted than in the other frames. In the speech encoder 4 according to the present embodiment the frames carry the complete information about the analysis coefficients or they carry no information about the analysis coefficients at all. The control unit 30 provides an output signal F indicating whether or not the multiplexer 6 has to introduce the signal LPC in the current frame. It is however observed that it is possible that the number of analysis parameters carried by each frame can vary.

The control unit 30 provides prediction coefficients $\alpha'_k$ to the interpolator 32. The values of $\alpha'_k$ are equal to the most recently determined (quantized) prediction coefficients if said LPC coefficients for the current frame are transmitted. If the LPC coefficients for the current frame are not transmitted, the value of $\alpha'_k$ is found by interpolating the values of $\alpha'_{k-1}$ and $\alpha'_{k+1}$.

The interpolator 32 provides linearly interpolated values $\alpha'_k[m]$ from $\alpha'_{k-1}$ and $\alpha'_{k+1}$ for each of the sub-frames in the present frame. The values of $\alpha'_k[m]$ are applied to the perceptual weighting filter 34 for deriving a "residual signal" rs[m] from the current sub-frame m of the input signal $S_k$. The search means 36 are arranged for finding the fixed codebook index, the fixed codebook gain, the adaptive codebook index and the adaptive codebook gain resulting in an excitation signal that give the best match with the current sub-frame m of the "residual signal" rs[m]. For each sub-frame m the excitation parameters fixed codebook index, fixed codebook gain, adaptive codebook index and adaptive codebook gain are available at the output EX of the speech encoder 4.

An example speech encoder according to FIG. 2, is a wide band speech encoder for encoding speech signals witi a bandwidth of 7 kHz with a bitrate varying from 13.6 kbit/s to 24 kbit/s. The speech encoder can be set at four so-called anchor bit rates. These anchor bitrates are starting values from which the bitrate can be decreased by reducing the fraction of frames that carry prediction parameters. In the table below the four anchor bitrates and the corresponding values of the frame duration, the number of samples in a frame and the numbers of sub-frames per frame is given.

| Bit rate (kbit/s) | Frame size (ms) | # samples per frame | # sub-frames/frame |
|---|---|---|---|
| 15.8 | 15 | 240 | 6 |
| 18.2 | 10 | 160 | 4 |
| 20.1 | 15 | 240 | 8 |
| 24.0 | 15 | 240 | 10 |

By reducing the number of frames in which LPC coefficients are present, the bitrate can be controlled in small steps. If the fraction of frames carrying LPC coefficients varies from 0.5 to 1, and the number of bits required to transmit the LPC coefficients for one frame is 66, the maximum obtainable bitrate reduction can be calculated. With a frame size of 10 ms, the bitrate for the LPC coefficients can vary from 3.3 kbit/s to 6.6 kbit/s. With a frame size of 15 ms, the bitrate for the LPC coefficients can vary from 2.2 kbit/s to 4.4 kbit/s. In the table below the maximum bitrate reduction and the minimum bitrate are given for the four anchor bitrates.

| Anchor bitrate (kbit/s) | Maximum bitrate reduction (kbit/s) | Minimum bitrate (kbit/s) |
|---|---|---|
| 15.8 | 2.2 | 13.6 |
| 18.2 | 3.3 | 14.9 |
| 20.1 | 2.2 | 17.9 |
| 24.0 | 2.2 | 21.8 |

Figure 3:
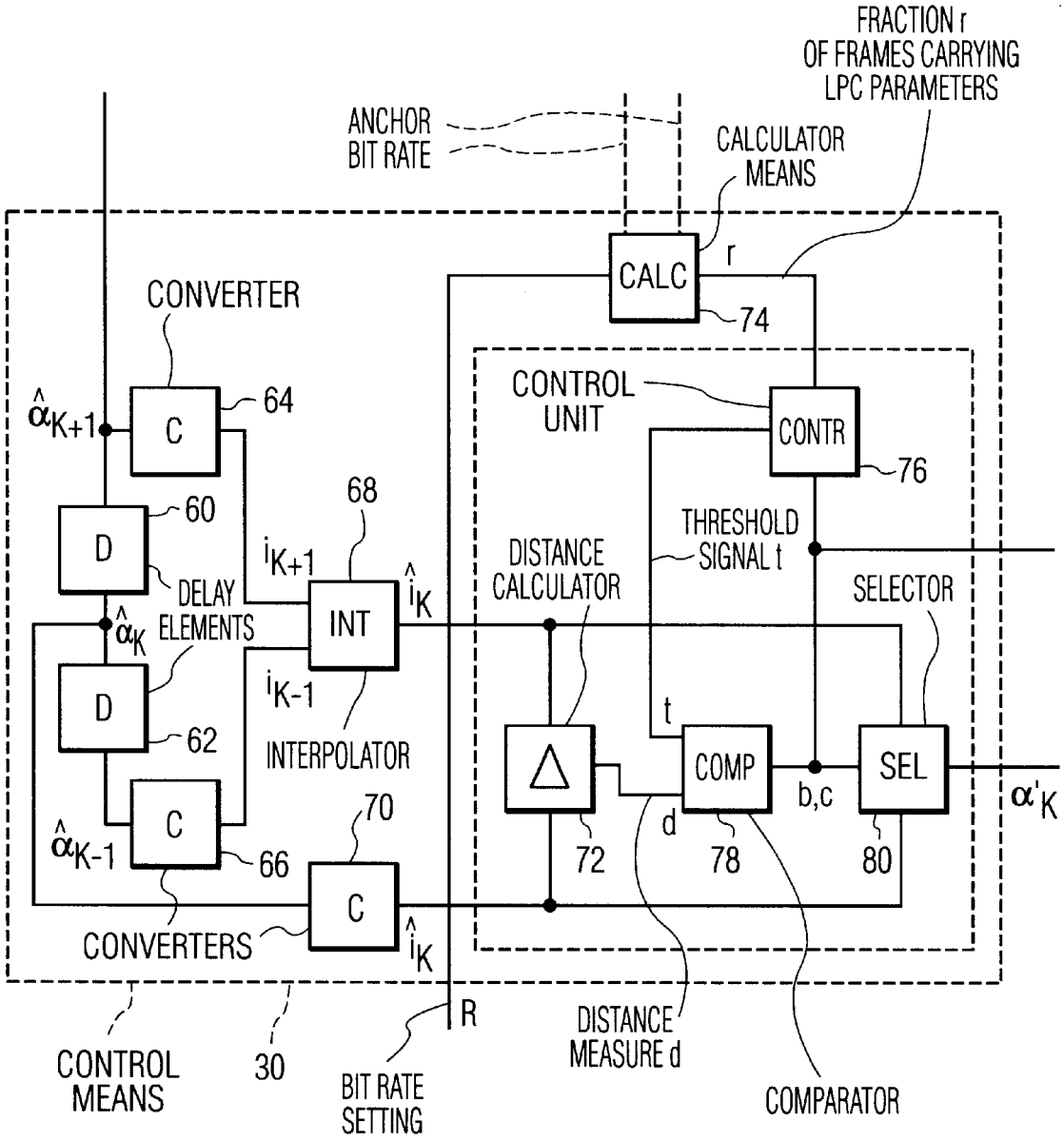
FIG. 3, an embodiment of the control means 30 to be used in the coding means according to FIG. 2.

In the control means 30 according to FIG. 3, a first input carrying the signal $\hat{\alpha}_{k+1}$, is connected to an input of a delay element 60 and to an input of a converter 64. An output of the delay element 60, carrying the signal $\hat{\alpha}_k$, is connected to an input of a delay element 62 and to an input of a converter 70. An output of the converter 64, carrying an output signal $i_{k+1}$, is connected to a first input of an interpolator 68. An output of the converter 66, carrying an output signal $i_{k-1}$, is connected to a second input of the interpolator 68. The output of the interpolator 68, carrying an output signal $\hat{i}_k$, is connected to a first input a distance calculator 72 and to a first input of a selector 80. An output of the converter 70, carrying an output signal $i_k$, is connected to a second input of the distance calculator 72 and to a second input of the selector 80.

An input signal R of the control means 30 is connected to an input of calculation means 74. A first output of the calculation means 74 is connected to a control unit 76. The signal at the first output of the calculation means 74 represents a fraction r of the frames that carries LPC parameters. Consequently said signal is a signal representing the bitrate setting.

A second and third output of the calculating means carry signals representing the anchor bitrate which are set in dependence on the signal R. An output of the control unit 76, carrying the threshold signal t, is connected to a first input of a comparator 78. An output of the distance calculator 72 is connected to a second input of the comparator 78. An output of the comparator 78 is connected to a control input of the selector 80, to an input of the control unit 76 and to an output of the control means 30.

In the control means according to FIG. 3, the delay elements 60 and 62 provide delayed sets of reflection coefficients $\hat{\alpha}_k$ and $\hat{\alpha}_{k-1}$ from the set of reflection coefficients $\hat{\alpha}_{k+1}$. The converters 64, 70 and 66 calculate coefficients $i_{K+1}$ $i_K$ and $i_{K-1}$ being more suited for interpolation than the coefficients $\hat{\alpha}_{k+1}$, $\alpha_k$ and $\hat{\alpha}_{k-1}$. The interpolator 68 derives an interpolated value $\hat{i}_k$ from the values $i_{K+1}$ and $i_{K-1}$.

The distance calculator 72 determines a distance measure d between the set prediction parameters $i_K$ and the set of prediction parameters $\hat{i}_k$ interpolated from $i_{K+1}$ and $i_{K-1}$. A suitable distance measure d is given by:

$$d = \left[\frac{1}{2\pi}\int_0^{2\pi}\left(10\log H(\omega) - 10\log\hat{H}(\omega)\right)^2 d\omega\right]^{\frac{1}{2}} \quad (1)$$

In (1) H(ω) is the spectrum described by the coefficients $i_K$ and $\hat{H}$ (ω) is the spectrum described by the coefficients $\hat{i}_k$. The measure d is commonly used, but experiments wave shown that the more easily calculable L1 norm gives comparable results. For this L1 norm can be written:

$$d = \frac{1}{P}\sum_{n=1}^{P}\left|i_k[n] - \hat{i}_k[n]\right| \quad (2)$$

In (2) P is the number of prediction coefficients determined by the analysis means 22. The distance measure d is compared by the comparator 78 with the threshold t. If the distance d is larger than the threshold t, the output signal c of the comparator 78 indicates that the LPC coefficients of the current frame are to be transmitted. If the distance measure d is smaller than the threshold t, the output signal c of the comparator 78 indicates that the LPC coefficients of the current frame are not transmitted. By counting over a predetermined period of time (e.g. over k frames, k having a typical value of 100) the number of times a that the signal c indicated the transmission of the LPC coefficients, a measure a for the actual fraction of the frames comprising LPC parameters is obtained. Given the parameters corresponding to the anchor bitrate chosen, this measure a is also a measure for the actual bitrate.

The control means 30 are arranged for comparing a measure for the actual bitrate with a measure for the bitrate setting, and for adjusting the actual bitrate if required. The calculation means 74 determines from the signal R, the anchor bitrate and the fraction r. In case a certain bitrate R can be achieved starting from two different anchor bitrates, the anchor bitrate resulting in the best speech quality is chosen. It is convenient to store the value of the anchor bitrate as function as the signal R in a table. If the anchor bitrate has been chosen, the fraction of the frames carrying LPC coefficients can be determined.

First the values $B_{MAX}$ and $B_{MIN}$ representing the maximum value and the minimum value for the numbers of bits per frame are determined according to:

$$B_{MAX}=b_{HEADER}+b_{EXCITATION}+b_{LPC} \quad ((4)$$

$$B_{MIN}=b_{HEADER}+b_{EXCITATION} \quad ((5)$$

In (4) and (5) $b_{HEADER}$ is the number of header bits in a frame, $b_{EXCITATION}$ is the number of bits representing the excitation signal, and $b_{Lpc}$ is the number of bits representing the analysis coefficients. If the signal R represents a requested bitrate $B_{REQ}$, for the fraction of frames r carrying LPC parameters can be written:

$$r = \frac{B_{REQ} - B_{MIN}}{B_{MAX} - B_{MIN}} \quad ((6)$$

It is observed that in the present embodiment, the minimum value of r is 0.5.

The control unit 76 determines the difference between the fraction r and the actual fraction a of the frames which carry LPC parameters. In order to adjust the bitrate according to the difference between the bitrate setting and the actual bitrate the threshold t is increased or decreased. If the threshold t is increased, the difference measure d will exceed said threshold for a smaller number of frames, and the actual bitrate will be decreased. If the threshold t is decreased, the difference measure d will exceed said threshold for a larger number of frames, and the actual bitrate will be increased. The update of the threshold t in dependence on the measure r for the bitrate setting and the measure b for the actual bitrate is performed by the control unit 76 according to:

$$t = \begin{cases} t' + c_1 \cdot |r - b| & \text{if } b \geq r \\ t' - c_2 \cdot |r - b| & \text{if } b < r \end{cases} \quad (3)$$

In (3) t' is the original value of the threshold, and $c_1$ and $c_2$ are constants.

Figure 4:
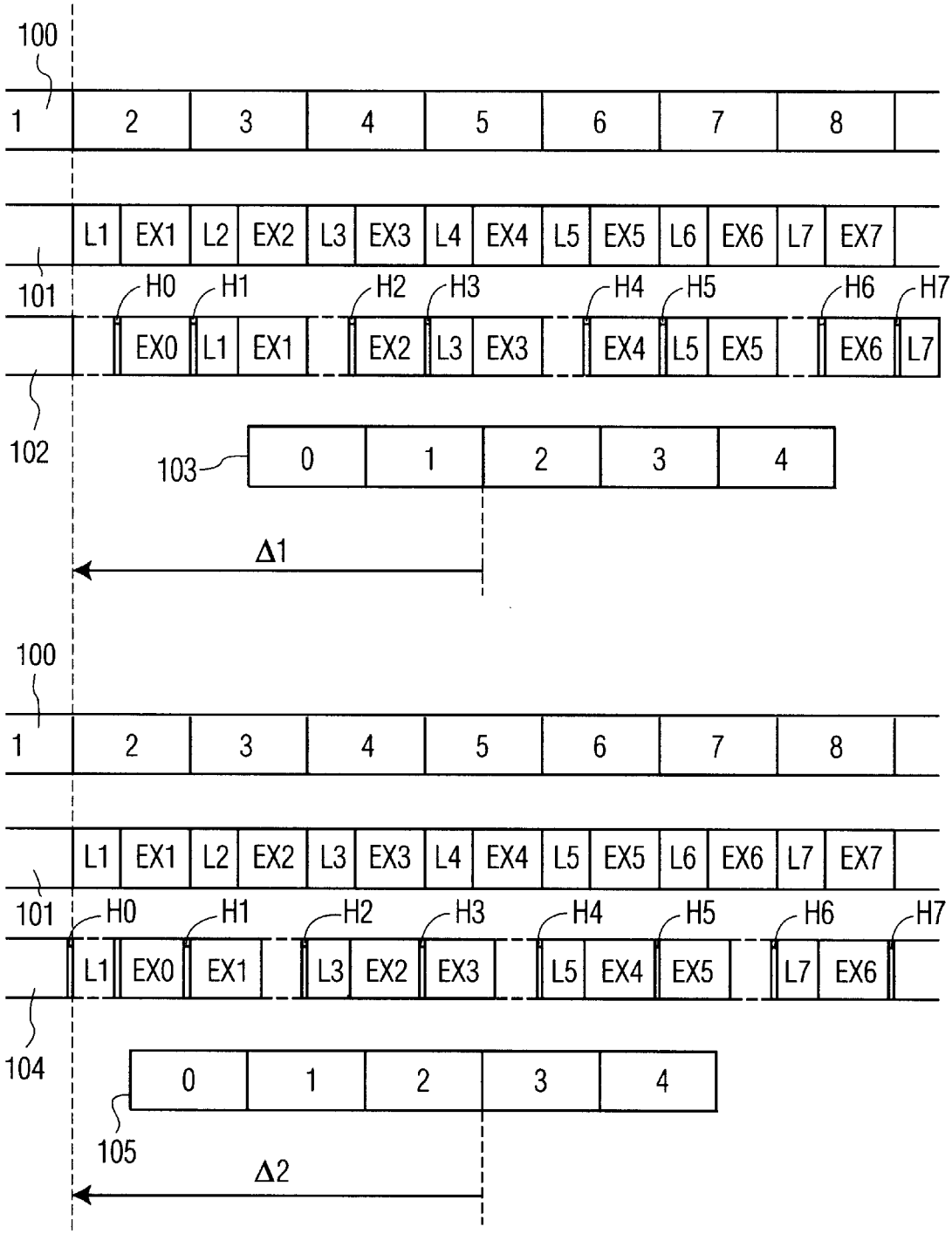
FIG. 4, a diagram showing a sequence of input speech frames, the data frames derived therefrom and the speech frames reconstructed from said data frames at the receiver.

FIG. 4 shows in graph 100 a sequence of frames 1 . . . 8 comprising speech signal samples. Graph 101 shows frames with coefficients corresponding to the frames of speech signals in graph 100. For each of the frames 1 . . . 8 of speech signal samples, LPC coefficients L and excitation coefficients EX are determined.

Graph 102 shows the data frames as they are transmitted by a transmission system according to the prior art. It is assumed that on average half of the data frames are complete data frames carrying LPC and excitation coefficients corresponding to their frames of speech signal samples. In the example of graph 102, the data frames 1, 3, 5 and 7 are complete data frames. The remaining (incomplete) data frames 0, 2, 4 and 6 carry only the excitation coefficients corresponding to their frames of speech samples. The delay between the data frames according to graph 101 and graph 102 is present to enable the decision whether a data frame to be transmitted has to be a complete or incomplete data frame. For taking this decision the LPC coefficients of the next frame of speech signal samples have to be available.

The header $H_i$ could comprises frame synchronization signals, and it comprises the first and second indicators as explained above.

In graph 103 the sequence of frames of speech signal samples decoded from the data frames according to graph 102 is shown. It can be seen that a delay of more than three frame intervals is present between the transmitted and received frames of speech signal samples. In the receiver this delay is caused because a frame of speech samples corresponding to an incomplete data frame cannot be reconstructed before the next frame carrying LPC coefficients is received. In graph 103, frame 0 of speech signal samples can not be reconstructed before the LPC parameters L1 corresponding to speech frame 1 are received. The same is valid for the speech frames 2 and 4.

In the transmission system according to the present invention, the data frames are transmitted as is shown in graph 104. Now the incomplete frames 0, 2 and 4 carry the LPC coefficients from the next complete frame 1, 3 and 5 respectively. The earlier transmission of the LPC coefficients of the next complete frame, allows the interpolation to be performed to obtain the LPC coefficients of the incomplete frame to be started one frame interval earlier. In graph 104 the reconstruction of speech frame 0 can already be started as soon the data frame corresponding to frame 0 (including the LPC parameters of speech frame 1) is received. As can be seen from graph 105 this results in a considerable reduction of the delay of the frames of speech signal samples.

Figure 5:
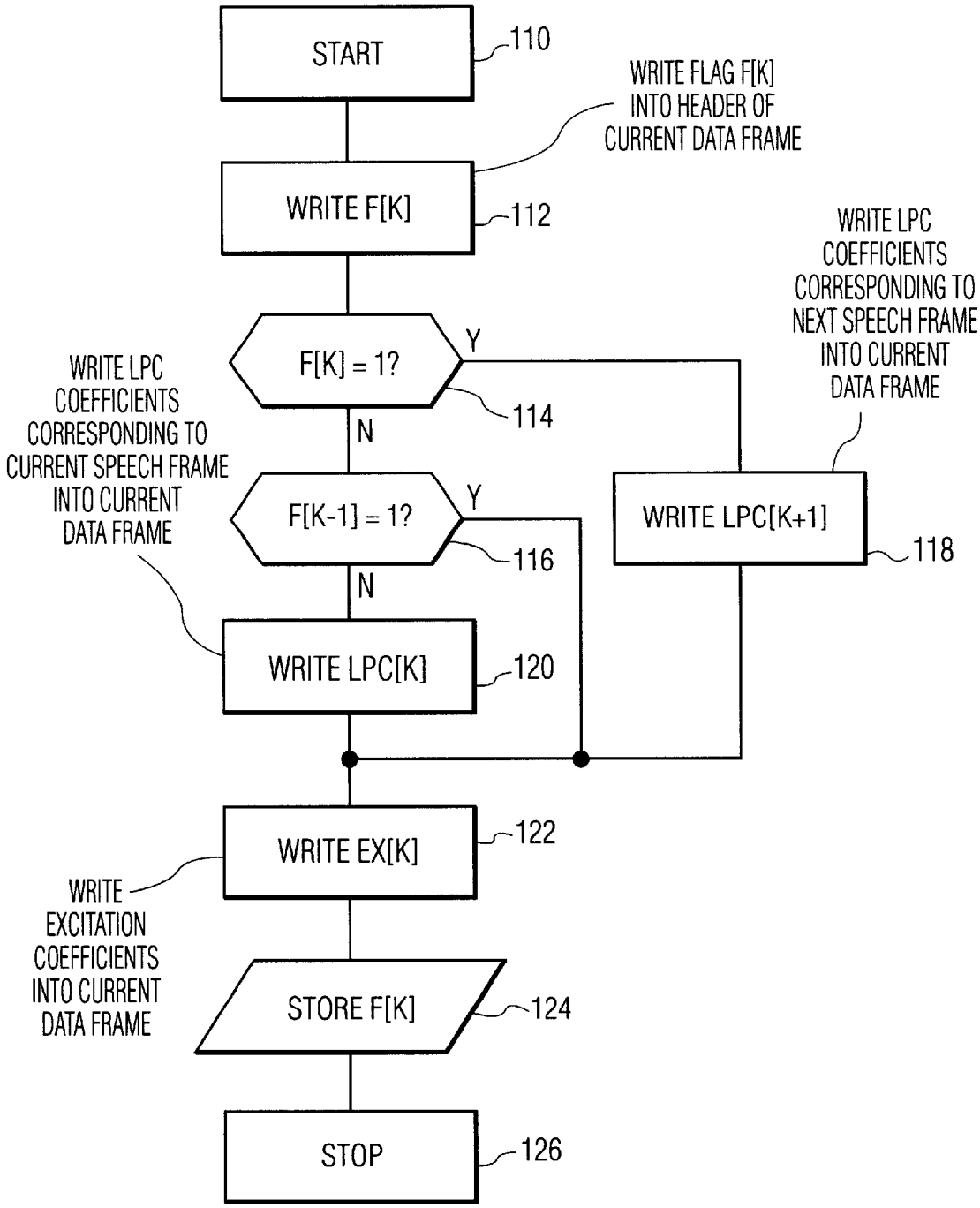
FIG. 5, a flow diagram of a program for a programmable processor to implement the multiplexer 6.

In the flow graph of FIG. 5 the numbered instructions have the meaning according to the following table:

| No. | Label | Meaning |
|---|---|---|
| 110 | START | The program is started and the used variables are initialized. |
| 112 | WRITE F[K] | The flag F[K] is written into the header of the current data frame. |
| 114 | F[K] = 1 ? | The value of the flag F[K] is compared with "1". |
| 115* | WRITE L[K] = 1 | The flag L[K] is set to 1 and is written into the current data frame. |
| 116 | F[K−1] = 1 ? | The value of the flag F[K−1] is compared with "1". |
| 117* | WRITE L[K] = 1 | The flag L[K] is set to 1 and is written into the current data frame. |
| 118 | WRITE LPC[K+1] | The LPC coefficients corresponding to the next speech frame are written into the current data frame |
| 119* | WRITE L[K] = 0 | The flag L[K] is set to 0 and is written into the current data frame. |
| 120 | WRITE LPC[K] | The LPC coefficients corresponding to the current speech frame are written into the current data frame. |
| 122 | WRITE EX[K] | The excitation coefficients are written into the current data frame. |
| 124 | STORE F[K] | The value of the flag F[K] is stored. |
| 126 | STOP | The program is terminated. |

Figure 9:
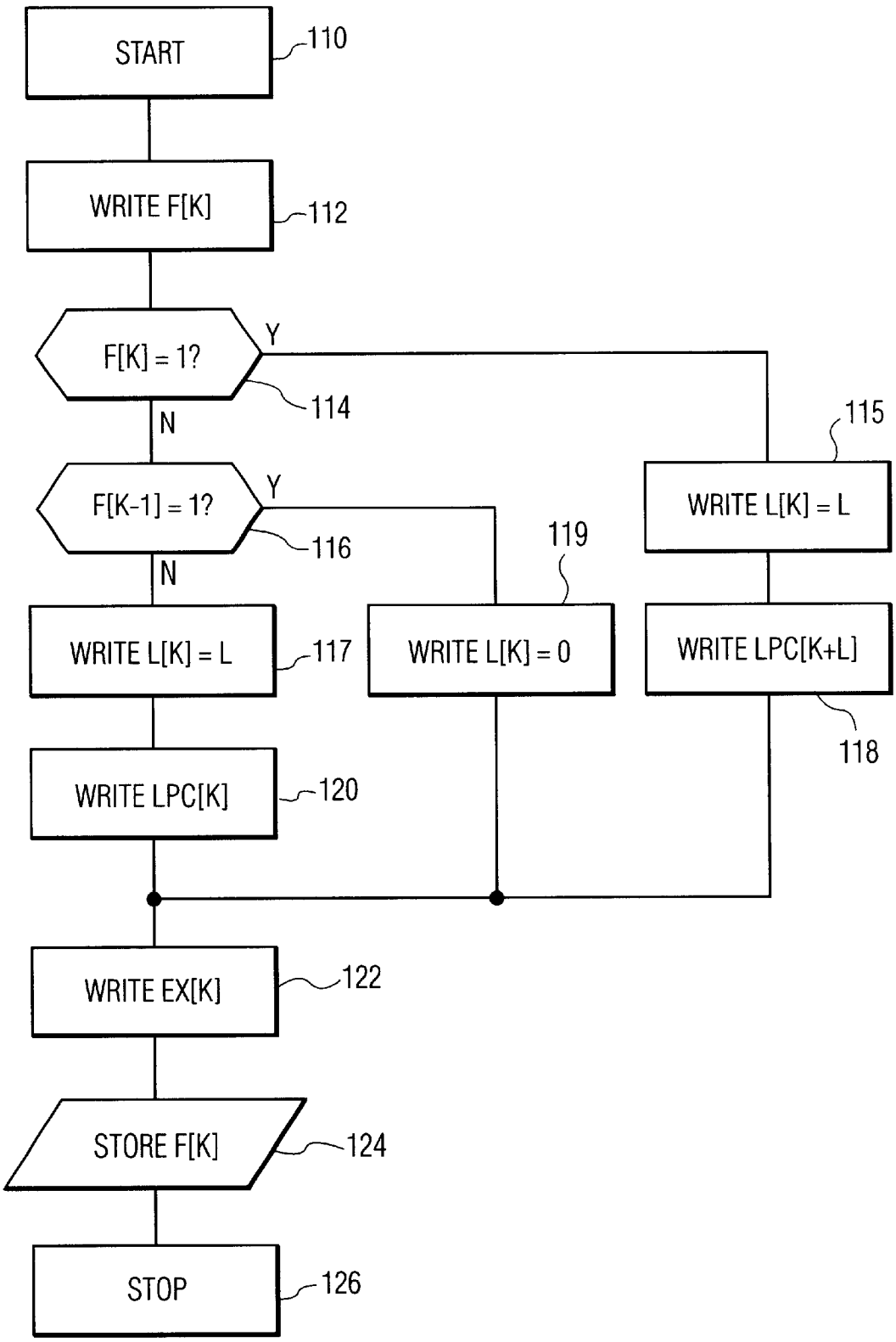
FIG. 9, a flow diagram with additional instructions.

The program according to the flow chart of FIG. 5 is executed once per frame interval, and it assembles the data frames from the output signals as provided by the speech encoder 4. It is observed that the program starts with assembling the $K^{th}$ data frame if the LPC coefficients of the $K+1^{th}$ frame of speech samples are already available. It is assumed that only the flag F is present to indicate whether the current frame is a complete frame. If also a flag L has to be used to indicate whether the current frame carries any LPC coefficients, the instructions 115, 117 and 119 indicated with * have to be added as indicated in FIG. 9.

In instruction 110 the program is started, and the used variables are set to their initial values if required. In instruction the 112 the flag F[K] as received from the speech encoder 6, is written in the header of the current data frame.

In instruction 114 the value of the flag F[K] is compared with 1. If F[K]=1, the current data frame is an incomplete data frame. In this case, in instruction 118 the LPC parameters LPC [K+1] of the next frame of speech signal samples is written in the current data frame. If a flag L has to be included, in instruction 115 the flag L is set to 1 and written into the header of the current data frame, in order to indicate the presence of LPC coefficients in the current data frame. Subsequently the program is continued at instruction 122.

If F[K]=0, the current data frame is a complete data frame. In instruction 116 the value of F[K−1] is compared with 1. A value of F[K−1] indicates that the previous data frame was an incomplete data frame. In this case the LPC coefficients of the current complete data frame have already been transmitted in said previous (incomplete) data frame. Consequently no LPC coefficients will be transmitted in the current data frame. If a flag L has to be included, in instruction 119 the flag L is set to 0 and written into the header of the current data frame, in order to indicate the absence of LPC coefficients in the current data frame. Subsequently the program is continued at instruction 122.

If the value of F[K−1] is equal to 0, the LPC coefficients of the current (complete) data frame have not been transmitted yet, and are written in the current data frame in production 120. If the flag L has to be included, in instruction 117 the flag L is set to 1 and written into the header of the current data frame, in order to indicate the presence of LPC coefficients in the current data frame.

In instruction 122 the excitation coefficients EX[K] are written into the current data frame. In instruction 124 the value of the flag F[K] is stored for use as F[K−1] when the program is executed the next time. In instruction 126 the program is terminated.

Figure 6:
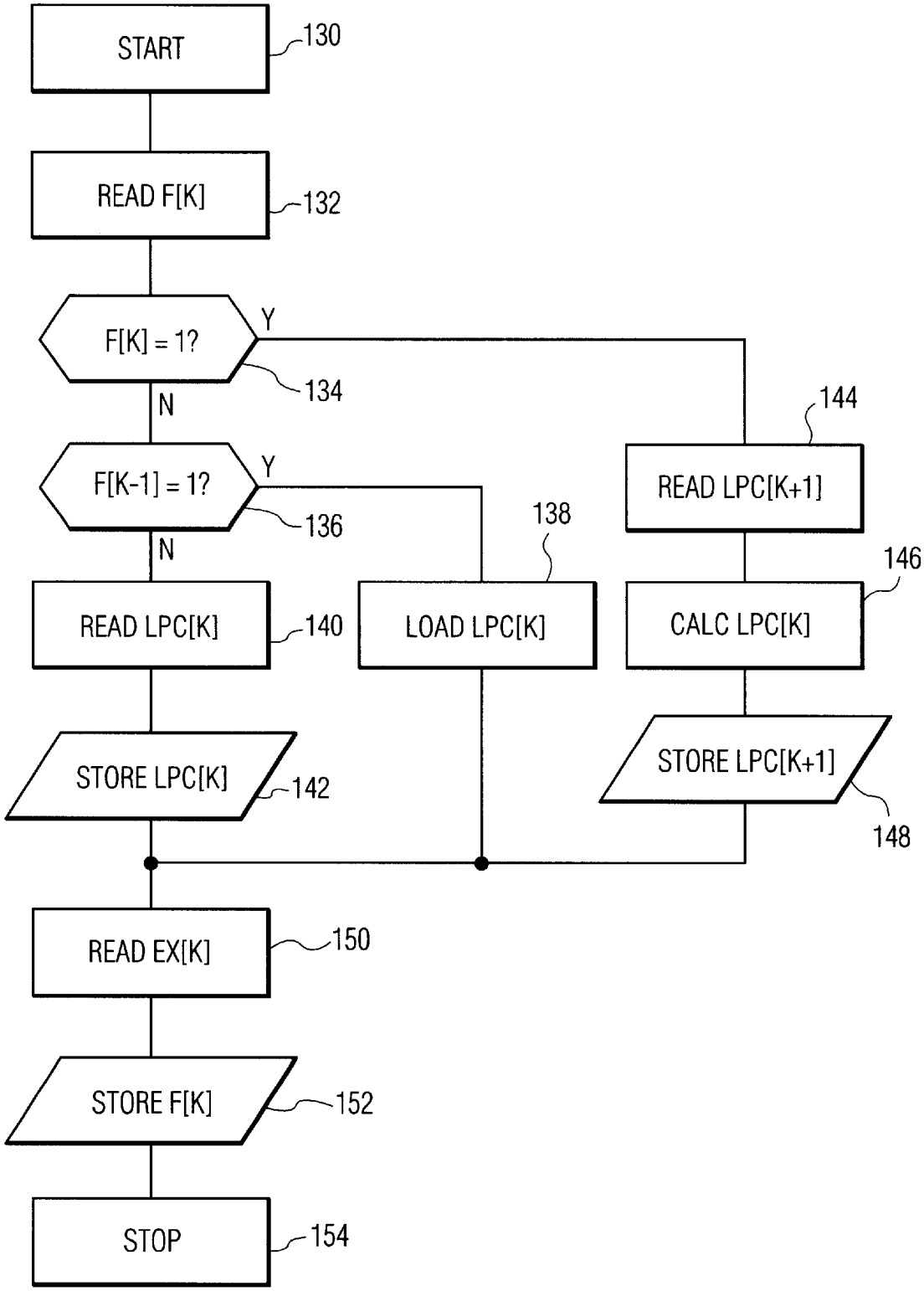
FIG. 6, a flow diagram of a program for a programmable processor to implement the demultiplexer 16.

In the flow graph of FIG. 6 the numbered instructions have the meaning according to the following table:

| No. | Label | Meaning |
|---|---|---|
| 130 | START | The program is started. |
| 132 | READ F[K] | The flag F[K] is read from the current data frame |
| 134 | F[K] = 1 ? | The value of the flag F[K] is compared with 1. |
| 136 | F[K−1] = 1 ? | The value of the flag F[K−1] is compared with 1. |
| 138 | LOAD LPC[K] | The set of LPC coefficients for the current frame is read from memory. |
| 140 | READ LPC[K] | The set of LPC coefficients for the current frame is read from the current data frame. |
| 142 | STORE LPC[K] | The set of LPC coefficients read from the data frame is stored in memory. |

-continued

| No. | Label | Meaning |
|---|---|---|
| 144 | READ LPC [K+1] | The set of LPC coefficients for the next frame is read from the current data frame. |
| 146 | CALC LPC[K] | The values of the LPC coefficients for the current frame are calculated. |
| 148 | STORE LPC[K+1] | The values of the LPC coefficients for the next frame is stored in memory. |
| 150 | READ EX[K] | The excitation signal for the current frame is read from the current data frame. |
| 152 | STORE F[K] | The flag F[K] is stored in memory. |
| 154 | STOP | The execution of the program is terminated. |

The program according to the flowchart of FIG. 6 is intended to implement the function of the demultiplexer in the case that only the flag F is used. Modifications required to deal also with the flag L are discussed later.

In instruction 130 the program is started. In instruction 132 the value of the flag F[K] is read from the current data frame. In instruction 134 the value of the flag F[K] is compared with 1.

If the flag F[K] is equal to 0, indicating that the present frame is a complete frame, in instruction 136 the value of F[K−1] is compared with 1. If F[K−1] is equal to 1, the previous data frame was an incomplete data frame carrying the LPC coefficients for the current frame. These coefficients were stored in memory the previous time the program was executed. Subsequently in instruction 138 the coefficients LPC[K] are loaded from memory and passed to the speech decoding means 18. After the execution of instruction 138 the program continues with instruction 150.

If the flag F[K−1] is equal to 0, the previous data frame was a complete data frame, and the LPC coefficients of the current frame are carried in the present data frame. Consequently in instruction 142 the coefficients LPC[K] are read from the present data frame. In instruction 142 the coefficients LPC[K] obtained in instruction 142 is written into memory for use when the program is executed for the next data frame. Further the coefficients LPC[K] are passed to the speech decoding means 18. Subsequently the program continues with instruction 150.

If in instruction 134 the value of the flag F[K] is equal to 1, the current data frame is an incomplete data frame which carries the coefficients LPC[K+1] corresponding to the next data frame. In instruction 146 the coefficients LPC[K] are calculated from the coefficients LPC[K−1] and LPC[K+1] according to:

$$LPC[K]_I = \frac{LPC[K-1]_I + LPC[K+1]_I}{2};\ 0 < I \leq P \tag{4}$$

In (4) I is a running parameter and P is the number of transmitted prediction coefficients. In instruction 148 the coefficient LPC[K] calculated in instruction 146 are stored in memory for use with the next data frame.

In instruction 150 the excitation coefficients EX[K] are read from the current data frame and passed to the speech decoding means 18. In instruction 152 the flag F[K] is stored in memory for use with the next data frame. In instruction 154 the execution of the program is terminated.

Figure 7:
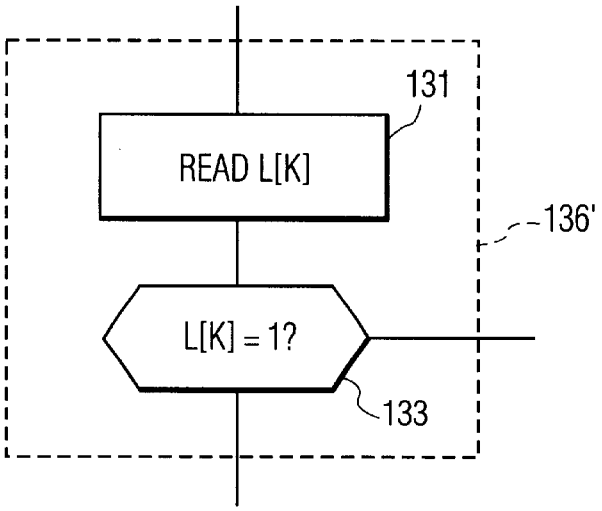
FIG. 7, a flow diagram of an alternative implementation of the instruction 138 in FIG. 6.

FIG. 7 shows the modification of instruction 136 in the program according to FIG. 6 in order to deal with the flag L. The advantage of using the flag L[K] in addition to the flag F[K] is that it is still possible to restart decoding of the data frames after one or more data frames are erroneous due to transmission error or are completely lost, because now no flag values from previous frames are required, as is the case when only the flag F is used. The numbered instructions in FIG. 7 have the meaning according to the table presented below:

| No. | Label | Meaning |
|---|---|---|
| 131 | READ L[K] | The flag L[K] is read from the current data frame. |
| 133 | L[K] = 1? | The flag L[K] is compared with the value 1. |

In instruction 131 the value L[K] is read from the current data frame, and in instruction 133 the value of L[k] is compared with 1. If the value of L[K] is 1, it means that the current data frames carries LPC coefficients. The program is continues with instruction 140 to read the LPC coefficients from the data frame. If the value of L[K] is equal to 0, it means that the current data frames does not carry any LPC coefficients. Hence the program continues with instruction 138 to load the previously received LPC coefficients from memory.

Figure 8:
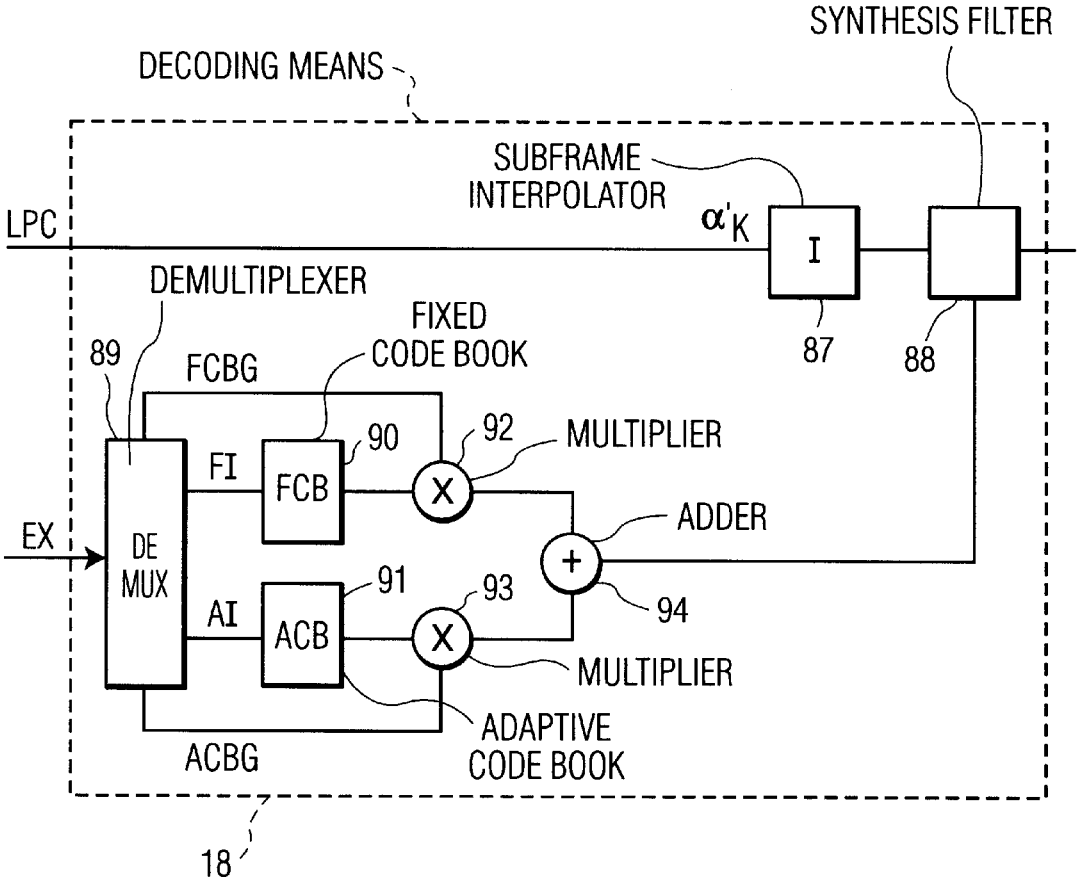
FIG. 8, a speech decoding means 18 to be used in the transmission system according to FIG. 1.

In the decoding means 18 according to FIG. 8, an input carrying a signal LPC, is connected to an input of a sub-frame interpolator 87. The output of the sub-frame interpolator 87 is connected to an input of a synthesis filter 88.

An input of the speech decoding means 18, carrying input signal EX, is connected to an input of a demultiplexer 89. A first output of the demultiplexer 89, carrying a signal FI representing the fixed codebook index, connected to an input of a fixed codebook 90. An output of the fixed codebook 90 is connected to a first input of a multiplier 92. A second output of the demultiplexer, carrying a signal FCBG (Fixed CodeBook Gain) is connected to a second input of the multiplier 92.

A third output of the demultiplexer 89, carrying a signal AI representing the adaptive codebook index, is connected to an input of an adaptive codebook 91. An output of the adaptive codebook 91 is connected to a first input of a multiplier 93. A second output of the demultiplexer 39, carrying a signal ACBG (Adaptive CodeBook Gain) is connected to a second input of the multiplier 93. An output of the multiplier 92 is connected to a first input of an adder 94, and an output of the multiplier 93 is connected to a second input of the adder 94. The output of the adder 94 is connected to an input of the adaptive codebook, and to an input of the synthesis filter 88.

In the speech decoding means 18 according to FIG. 8, the sub-frame interpolator 87 provides interpolated prediction coefficients for each of the sub-frames, and passes these prediction coefficients to the synthesis filter 88.

The excitation signal for the synthesis filter is equal to a weighted sum of the output signals of the fixed codebook 90 and the adaptive codebook 91. The weighting is performed by the multipliers 92 and 93. The codebook indices FI and AI are extracted from the signal EX by the demultiplexer 89. The weighting factors FCBG (Fixed CodeBook Gain) and ACBG (Adaptive CodeBook Gain) are also extracted from the signal EX by the demultiplexer 89. The output signal of the adder 94 is shifted into the adaptive codebook in order to provide the adaptation

What is claimed is:

1. Speech encoder for deriving complete and incomplete data frames from timely ordered frames of speech signal samples, said speech encoder comprising:

means for deriving a complete data frame from a first frame of said timely ordered frames, said complete data frame comprising a complete set of coefficients representing said first frame, and deriving an incomplete data frame from a second frame of said timely ordered frames, said incomplete data frame comprising an incomplete set of coefficients representing said second frame and at least one coefficient representing a third frame of said timely ordered frames, said third frame being later in time in said timely ordered frames than said second frame.

2. Speech decoder for decoding a signal comprising complete and incomplete data frames from timely ordered frames of speech signal samples, an incomplete data frame of said incomplete data frames comprising an incomplete set of coefficients representing a first frame of speech signal samples from which said incomplete set was derived and at least one coefficient representing a second frame of speech signal samples, said second frame of speech signal samples being later in time in said timely ordered frames than said first frame, said speech decoder comprising completion means for completing a received incomplete set of coefficients with interpolated coefficients obtained from received coefficients that were derived from other frames of speech signal samples than said first frame, said other frames surrounding said first frame and including said second frame.

3. Transmission system comprising:

a transmitter with a speech encoder for deriving complete and incomplete data frames from timely ordered frames of speech signal samples, said speech encoder comprising means for deriving a complete data frame from a first frame of said timely ordered frames, said complete data frame comprising a complete set of coefficients representing said first frame, for deriving an incomplete data frame from a second frame of said timely ordered frames, said incomplete data frame comprising an incomplete set of coefficients representing said second frame, for introducing at least one additional coefficient into said incomplete data frame, said at least one additional coefficient representing a frame of speech signal samples that is later in time in said timely ordered frames than said second frame, and for introducing into data frames a first indicator for indicating whether a frame is an incomplete data frame and a second indicator for indicating whether a data frame carries said at least one additional coefficient, said transmitter further comprising transmit means for transmitting said derived data frames to a receiver comprised in said system;

a receiver with a speech decoder, said speech decoder comprising completion means for completing a received incomplete set of coefficients with interpolated coefficients obtained from received coefficients that were derived from other frames of speech signal samples than said second frame, said other frames surrounding said second frame, and for further completing said received incomplete set of coefficients using at least one received additional coefficient.

4. Transmitter with a speech encoder for deriving complete and incomplete data frames from timely ordered frames of speech signal samples, said speech encoder comprising means for deriving a complete data frame from a first frame of said timely ordered frames, said complete data frame comprising a complete set of coefficients representing said first frame, for deriving an incomplete data frame from a second frame of said timely ordered frames, said incomplete data frame comprising an incomplete set of coefficients representing said second frame, for introducing at least one additional coefficient into said incomplete data frame, said at least one additional coefficient representing a frame of speech signal samples that is later in time in said timely ordered frames than said second frame, and for introducing into data frames a first indicator for indicating whether a frame is an incomplete data frame and a second indicator for indicating whether a data frame carries said at least one additional coefficient.

5. Receiver with receiving means and a speech decoder, said receiving means receiving complete and incomplete data frames derived in a transmitter from timely ordered frames of speech signal samples, an incomplete data frame of said incomplete data frames comprising an incomplete set of coefficients representing a first frame of speech signal samples from which said incomplete set was derived and at least one coefficient representing a second frame of speech signal samples, said second frame of speech signal samples being later in time in said timely ordered frames than said first frame, said speech decoder comprising completion means for completing a received incomplete set of coefficients with interpolated coefficients obtained from received coefficients that were derived from other frames of speech signal samples than said first frame, said other frames surrounding said first frame and including said second frame.

6. Speech encoder for deriving complete and incomplete data frames from timely ordered frames of speech signal samples, said speech encoder comprising:

means for deriving a complete data frame from a first frame of said timely ordered frames, said complete data frame comprising a complete set of coefficients representing said first frame, deriving an incomplete data frame from a second frame of said timely ordered frames, said incomplete data frame comprising an incomplete set of coefficients representing said second frame, introducing at least one additional coefficient into said incomplete data frame, said at least one additional coefficient representing a frame of speech signal samples that is later in time in said timely ordered frames than said second frame, and introducing into data frames a first indicator for indicating whether a frame is an incomplete data frame and a second indicator for indicating whether a data frame carries said at least one additional coefficient.

7. Speech transmission method of deriving complete and incomplete data frames from timely ordered frames of speech signal samples, said method comprising:

deriving a complete data frame from a first frame of said timely ordered frames, said complete data frame comprising a complete set of coefficients representing said first frame;

deriving an incomplete data frame from a second frame of said timely ordered frames, said incomplete data frame comprising an incomplete set of coefficients representing said second frame;

introducing at least one additional coefficient into said incomplete data frame, said at least one additional coefficient representing a frame of speech signal samples that is later in time in said timely ordered frames than said second frame;

introducing into data frames a first indicator for indicating whether a frame is an incomplete data frame and a second indicator for indicating whether a data frame carries said at least one additional coefficient;

transmitting said derived data frames;

receiving said transmitted derived data frames;

completing a received incomplete set of coefficients with interpolated coefficients obtained from received coefficients that were derived from other frames of speech signal samples than said second frame, said other frames surrounding said second frame; and further completing said received incomplete set of coefficients using said at least one received additional coefficient.

8. Speech encoding method of deriving complete and incomplete data frames from timely ordered frames of speech signal samples, said method comprising:

deriving a complete data frame from a first frame of said timely ordered frames, said complete data frame comprising a complete set of coefficients representing said first frame;

deriving an incomplete data frame from a second frame of said timely ordered frames, said incomplete data frame comprising an incomplete set of coefficients representing said second frame;

introducing at least one additional coefficient into said incomplete data frame, said at least one additional coefficient representing a frame of speech signal samples that is later in time in said timely ordered frames than said second frame; and introducing into data frames a first indicator for indicating whether a frame is an incomplete data frame and a second indicator for indicating whether a data frame carries said at least one additional coefficient.

9. Speech encoding method of deriving complete and incomplete data frames from timely ordered frames of speech signal samples, said method comprising:

deriving a complete data frame from a first frame of said timely ordered frames, said complete data frame comprising a complete set of coefficients representing said first frame; and deriving an incomplete data frame from a second frame of said timely ordered frames, said incomplete data frame comprising an incomplete set of coefficients representing said second frame and at least one coefficient representing a third frame of said timely ordered frames, said third frame being later in time in said timely ordered frames than said second frame.

* * * * *